US009958811B2

(12) United States Patent
Ida et al.

(10) Patent No.: US 9,958,811 B2
(45) Date of Patent: May 1, 2018

(54) IMAGE FORMING APPARATUS HAVING TRANSFER BELT

(71) Applicant: Oki Data Corporation, Tokyo (JP)

(72) Inventors: Koji Ida, Tokyo (JP); Yoshitaka Miyazaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days. days.

(21) Appl. No.: 15/288,358

(22) Filed: Oct. 7, 2016

(65) Prior Publication Data

US 2017/0102643 A1 Apr. 13, 2017

(30) Foreign Application Priority Data

Oct. 9, 2015 (JP) ..... 2015-200831

(51) Int. Cl.
*G03G 15/16* (2006.01)
*G03G 15/00* (2006.01)

(52) U.S. Cl.
CPC ..... *G03G 15/1615* (2013.01); *G03G 15/162* (2013.01); *G03G 15/5054* (2013.01)

(58) Field of Classification Search
CPC ..... G03G 15/162; G03G 15/1615; G03G 15/5054; G03G 2215/0161
See application file for complete search history.

(56) References Cited

U.S. PATENT DOCUMENTS

2014/0037343 A1* 2/2014 Nakashima ..... G03G 15/0131 399/301

FOREIGN PATENT DOCUMENTS

JP 2011123487 A 6/2011

* cited by examiner

*Primary Examiner* — Hoang Ngo
(74) *Attorney, Agent, or Firm* — Panitch Schwarze Belisario & Nadel LLP

(57) ABSTRACT

An image forming apparatus includes an image forming unit that forms a developer image, a transfer portion that transfers the developer image to a transfer object, an endless transfer belt that rotates passing between the image forming unit and the transfer portion, a driving roller that drives the transfer belt to rotate, a plurality of marks provided on the transfer belt and arranged in a rotating direction of the transfer belt, a measurement unit that measures a rotation period of the transfer belt using the plurality of marks, and a controller that adjusts a timing at which the image forming unit forms the developer image, based on a measurement result of the rotation period measured by the measurement unit. A circumferential length L of the transfer belt in the rotating direction has a length based on a natural number multiple of a circumferential length m of the driving roller.

14 Claims, 6 Drawing Sheets

IMAGE FORMING APPARATUS HAVING TRANSFER BELT

CROSS-REFERENCE TO RELATED APPLICATIONS

This Application claims priority from Application 2015-200831 filed on Oct. 9, 2015 in Japan, the entire contents of which are incorporated herein by reference in their entirety.

BACKGROUND OF THE INVENTION

The present invention relates to an image forming apparatus that forms an image using an electrophotographic method.

An image forming apparatus is configured to, for example, form an image, transfer the image onto a recording medium such as a paper, fix the image to the recording medium, and eject the recording medium (see, for example, Japanese Patent Application Publication No. 2011-123487).

There is a demand for an image forming apparatus capable of forming an excellent image, i.e., capable of enhancing image quality.

SUMMARY OF THE INVENTION

The present invention is intended to provide an image forming apparatus capable of enhancing image quality.

According to an aspect of the present invention, there is provided an image forming apparatus including an image forming unit that form a developer image, a transfer portion that transfers the developer image formed by the image forming unit to a transfer object, an endless transfer belt that rotates passing through between the image forming unit and the transfer portion, a driving roller that drives the transfer belt to rotate, a plurality of marks provided on the transfer belt and arranged in a rotating direction of the transfer belt, a measurement unit that measures a rotation period of the transfer belt using the plurality of marks, and a controller that adjusts a timing at which the image forming unit forms the developer image, based on a measurement result of the rotation period measured by the measurement unit. A circumferential length L of the transfer belt in the rotating direction is set to a length based on a natural number multiple of a circumferential length m of the driving roller.

Such a configuration enables enhancement of image quality.

DETAILED DESCRIPTION OF THE PREFERRED EMBODIMENT

Hereinafter, an embodiment of the present invention and modifications of the embodiment will be described with reference to the drawings.

First, description will be made of the embodiment directed to an image forming apparatus of an intermediate transfer type configured to satisfy a relationship: $L1=(m\times N1)$. Then, description will be made of the first modification directed to an image forming apparatus of the intermediate transfer type configured to satisfy a relationship: $L2\neq(m\times N1)$. Then, description will be made of the second modification directed to an image forming apparatus of a direct transfer type.

1. Embodiment

Basic Configuration

Figure 1:
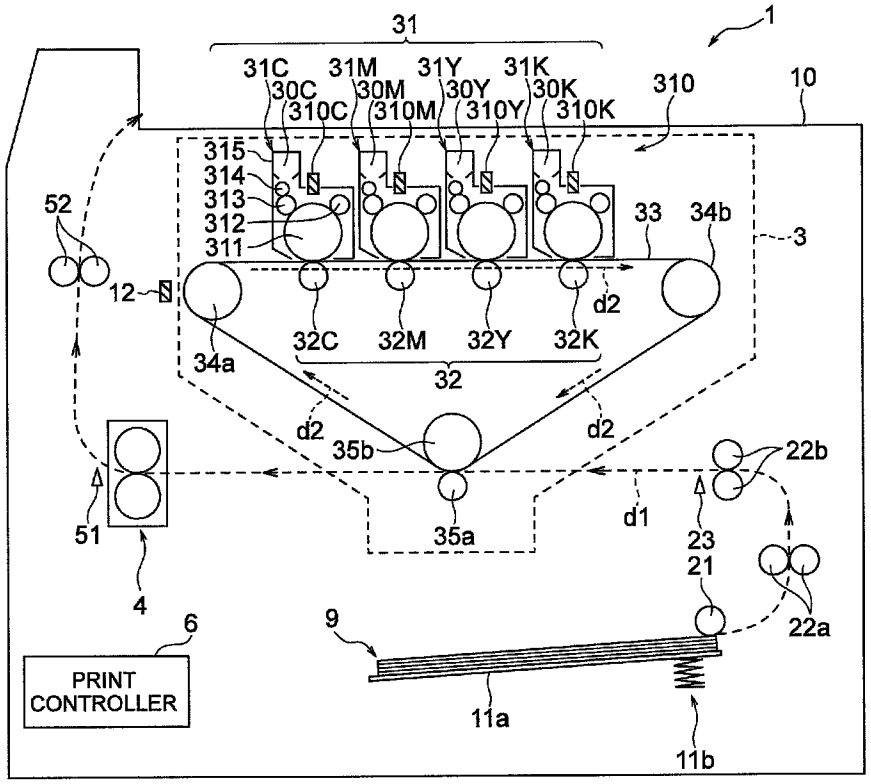
FIG. 1 is a schematic view showing a configuration example of an image forming apparatus according to an embodiment of the present invention.

FIG. 1 is a schematic view showing a configuration example of an image forming apparatus (i.e., an image forming apparatus 1) according to the embodiment of the present invention. The image forming apparatus 1 functions as a printer (for example, a color printer) that forms an image (for example, a color image) on a recording medium 9 using an electrophotographic method. The image forming apparatus 1 is of an intermediate transfer type, and transfers a toner image (i.e., a developer image) to the recording medium 9 via an intermediate transfer belt 33 described later. Here, the image forming apparatus 1 corresponds to an example of an "image forming apparatus" of the present invention.

As shown in FIG. 1, the image forming apparatus 1 includes a supporting plate member 11*a*, a spring 11*b*, a hopping roller 21, two pairs of conveying rollers 22*a* and 22*b*, a writing sensor 23, an image forming section 3, a belt mark sensor 12, a fixing device 4 (i.e., a fixing unit), an ejection sensor 51, a pair of ejection rollers 52, and a print controller 6. These components are housed in a predetermined housing 10 having an openable and closable cover (not shown) or the like.

<Supporting Plate Member 11*a* and the Like>

The supporting plate member 11*a* is configured to support (i.e., store) a stack of the recording media 9 (for example, cut sheets). In an example shown in FIG. 1, the supporting plate member 11*a* is disposed in a lower part of the image forming apparatus 1. The spring 11*b* pushes the supporting plate member 11*a* upward so that the recording medium 9 on the supporting plate member 11*a* is pressed against the hopping roller 21.

The hopping roller 21 rotates to feed the recording medium 9 from the supporting plate member 11*a* (starting with an uppermost recording medium 9) in a direction toward the conveying rollers 22*a* and 22*b*. That is, the hopping roller 21 constitutes a feeding mechanism.

The conveying rollers 22*a* and 22*b* rotate to convey the recording medium 9 in a conveyance direction d1 (i.e., along a conveyance path d1) toward a secondary transfer roller 35*a* described later.

The writing sensor 23 is disposed downstream of the conveying rollers 22*a* and 22*b*, and is configured to detect a leading end of the recording medium 9 conveyed along the conveyance path d1.

<Image Forming Section 3>

The image forming section 3 is configured to form an image on the recording medium 9 conveyed by the conveying rollers 22*a* and 22*b*. In this example, the image forming section 3 includes four image drum units (i.e., image forming units) 31C, 31M, 31Y and 31K and the secondary transfer roller 35*a* as shown in FIG. 1. The image forming section 3 further includes four primary transfer rollers 32C, 32M, 32Y and 32K, an intermediate transfer belt 33, a driving roller 34*a*, an idle roller 34*b* and a secondary transfer backup roller 35*b*. The primary transfer rollers 32C, 32M, 32Y and 32K, the intermediate transfer belt 33, the driving roller 34*a*, the idle roller 34*b* and the secondary transfer backup roller 35*b* constitute an intermediate transfer belt unit. The image forming section 3 further includes, for example, actuators such as motors, crutches and the like.

The image drum units 31C, 31M, 31Y and 31K are arranged in a conveyance direction d2 (i.e., along a conveyance path) of the intermediate transfer belt 33 as shown in FIG. 1. To be more specific, the image drum units 31C, 31M, 31Y and 31K are arranged in this order in the conveyance direction d2, i.e., from upstream to downstream. In this regard, the image drum units 31C, 31M, 31Y and 31K are respectively mounted to predetermined mounting positions (in this example, four mounting positions) in the housing 10.

Here, each of the image drum units 31C, 31M, 31Y and 31K corresponds to an example of an "image forming unit" of the present invention.

The image drum units 31C, 31M, 31Y and 31K are configured to form toner images (i.e., developer images) using toners (i.e., developers) of different colors on the intermediate transfer belt 33 described later. To be more specific, as shown in FIG. 1, the image drum unit 31C forms a toner image of cyan (C) using a cyan toner 30C. The image drum unit 31M forms a toner image of magenta (M) using a magenta toner 30M. The image drum unit 31Y forms a toner image of yellow (Y) using a yellow toner 30Y. The image drum unit 31K forms a toner image of black (K) using a black toner 30K.

Here, each of the toner images formed using the toners 30C, 30M, 30Y and 30K corresponds to an example of a "developer image" of the present invention.

In this regard, each of the cyan, magenta, yellow and black toners 30C, 30M, 30Y and 30K may contain colorant including dye or pigment in a single kind or in a combination of a plurality of kinds.

The image drum units 31C, 31M, 31Y and 31K have the same configuration except for the toners used for image formation. Each of the image drum units 31C, 31M, 31Y and 31K includes a system for forming the toner image. As shown in FIG. 1, the system for forming the toner image includes a toner cartridge 315 (i.e., a developer container), a photosensitive drum 311 (i.e., an image bearing body), a charging roller 312 (i.e., a charging member), a developing roller 313 (i.e., a developer bearing body), a supplying roller 314 (i.e., a developer supplying member) and a cleaning member. Further, exposure heads 310C, 310M, 310Y and 310K (i.e., exposure devices) are disposed so as to respectively face the image drum units 31C, 31M, 31Y and 31K (more specifically, the photosensitive drums 311) as shown in FIG. 1.

The toner cartridge 315 is a container storing the toner of the corresponding color therein. The photosensitive drum 311 is configured to bear an electrostatic latent image on a surface (i.e., a surface layer) thereof, and is composed of a photosensitive body (for example, an organic photosensitive body). The charging roller 312 is configured to uniformly charge the surface of the photosensitive drum 311, and is disposed so as to contact the surface (i.e., a circumferential surface) of the photosensitive drum 311. The developing roller 313 is configured to bear the toner on a surface thereof for developing the electrostatic latent image, and is disposed so as to contact the surface of the photosensitive drum 311. The supplying roller 314 is configured to supply the toner to the developing roller 313, and is disposed so as to contact the surface of the developing roller 313. The cleaning member is configured to scrape off the toner remaining on the surface of the photosensitive drum 311 after the toner image is primarily transferred to the intermediate transfer belt 33 (i.e., a transfer object), and remove the toner from the surface of the photosensitive drum 311.

Each of the exposure heads 310C, 310M, 310Y and 310K is configured to form an electrostatic latent image on the surface (i.e., the surface layer) of the photosensitive drum 311 by irradiating the surface of the photosensitive drum 311 with light (irradiation light). Each of the exposure heads 310C, 310M, 310Y and 310K includes, for example, a plurality of light sources that emit the irradiation light, and a lens array focusing the irradiation light onto the surface of the photosensitive drum 311. The light sources may be constituted by, for example, LEDs (Light Emitting Diodes), laser elements or the like.

The intermediate transfer belt unit is configured so that the toner images of respective colors formed of the image drum units 31C, 31M, 31Y and 31K are primarily transferred to the intermediate transfer belt 33 as shown in FIG. 1. The primarily transferred toner image is then secondarily transferred from the intermediate transfer belt 33 to the recording medium 9 conveyed in the conveyance direction d1.

As described above, the intermediate transfer belt unit includes the four primary transfer rollers 32C, 32M, 32Y and 32K, the intermediate transfer belt 33, the driving roller 34*a*, the idle roller 34*b*, and the secondary transfer backup roller 35*b*.

The primary transfer rollers 32C, 32M, 32Y and 32K are configured to primarily (electrostatically) transfer the toner images of respective colors formed by the image drum units 31C, 31M, 31Y and 31K to the intermediate transfer belt 33. As shown in FIG. 1, the primary transfer rollers 32C, 32M, 32Y and 32K are disposed so as to respectively face the image drum units 31C, 31M, 31Y and 31K (more specifically, the photosensitive drums 311) via the intermediate transfer belt 33. Here, each of the primary transfer rollers 32C, 32M, 32Y and 32K corresponds to an example of a "transfer portion" of the present invention.

The secondary transfer backup roller 35*b* is disposed so as to face the secondary transfer roller 35*a* described later. As shown in FIG. 1, the recording medium 9 passes through between the secondary transfer roller 35*a* and the secondary transfer backup roller 35*b* along the conveyance path d1. The secondary transfer roller 35*a* and the secondary transfer backup roller 35*b* constitute a secondary transfer portion. Here, the secondary transfer roller 35*a* and the secondary transfer backup roller 35*b* respectively correspond to examples of the "transfer portion" of the present invention.

The intermediate transfer belt 33 has a surface (i.e., an outer circumferential surface) to which the toner images of respective colors are primarily transferred from the image drum units 31C, 31M, 31Y and 31K as described above. In other words, the intermediate transfer belt 33 temporarily bears the toner images of the respective colors on the surface thereof. The intermediate transfer belt 33 is stretched around a plurality of rollers including the driving roller 34*a* and the idle roller 34*b* as shown in FIG. 1. Further, the intermediate transfer belt 33 rotates passing through between the image drum units 31C, 31M, 31Y and 31K and the primary transfer rollers 32C, 32M, 32Y and 32K. The intermediate transfer belt 33 is driven by the driving roller 34*a* to rotate in the conveyance direction d2 (i.e., a rotating direction) as shown in FIG. 1. The toner images of the respective colors having been primarily transferred to the surface of the intermediate transfer belt 33 are secondarily transferred to the recording medium 9 as described later. A plurality of belt marks 330 are provided on the intermediate transfer belt 33 as described later.

Here, the intermediate transfer belt 33 corresponds to an example of a "transfer object" of the present invention, and also corresponds to a "transfer belt" of the present invention. Further, the driving roller 34*a* corresponds to an example of a "driving roller" of the present invention.

The secondary transfer roller 35*a* is configured to secondarily (electrostatically) transfer the toner images of the respective colors (having been primarily transferred to the intermediate transfer belt 33) to the recording medium 9.

Figure 2:
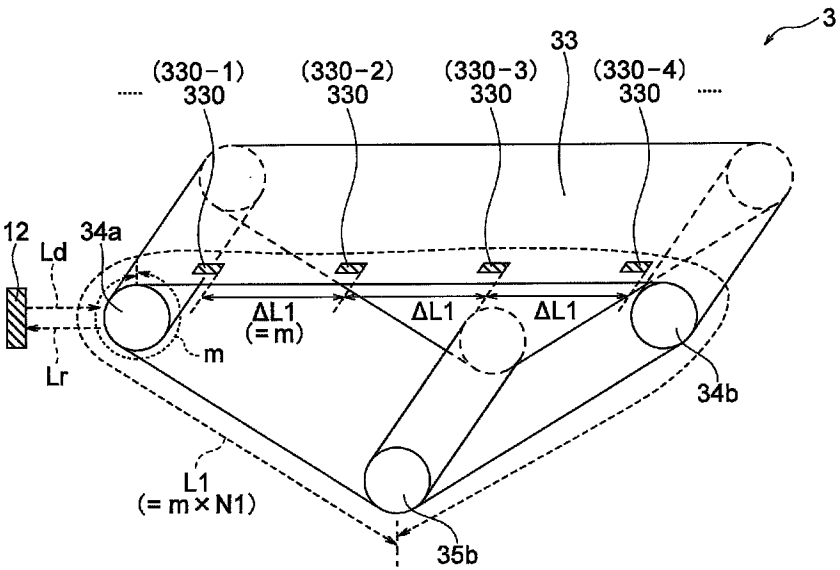
FIG. 2 is a schematic perspective view showing a configuration example of a part of an image forming section of the image forming apparatus shown in FIG. 1.

Configurations of the belt mark sensor 12 and the belt marks 330 will be described with reference to FIG. 1 and FIG. 2. FIG. 2 is a schematic perspective view showing a configuration example of a part of the image forming section 3.

<Belt Mark Sensor 12>

As shown in FIG. 2, the belt mark sensor 12 is disposed beside the image forming section 3. To be more specific, the belt mark sensor 12 is disposed in the vicinity of the driving roller 34*a*. The belt mark sensor 12 emits light Ld (referred to as detection light Ld) such as infrared light toward the intermediate transfer belt 33, and receives light Lr (referred to as reflected light Lr) reflected by the intermediate transfer belt 33. The belt mark sensor 12 performs a predetermined measurement in cooperation with the print controller 6 by emitting the detection light Ld toward the surface of the intermediate transfer belt 33 or a predetermined mark (i.e., the belt mark 330) formed thereon, and receiving the reflected light Lr from the surface of the intermediate transfer belt 33 or the belt mark 330. That is, the belt mark sensor 12 and the print controller 6 measure a rotation period of the intermediate transfer belt 33 using the detection light Ld and the reflected light Lr. The belt mark sensor 12 functions as a sensor for measuring the rotation period of the intermediate transfer belt 33.

Further, the belt mark sensor 12 includes a light emitting portion and a light receiving portion. The light emitting portion includes a light emitting element that emits the detection light Ld. The light emitting element is constituted by, for example, an LED (Light Emitting Diode). The light receiving portion includes, for example, a light receiving element having a sensitivity in an infrared region. The light receiving element is constituted by, for example, a phototransistor. In this regard, the light receiving portion is optically adjusted so that the light receiving portion receives specular reflection light as the reflected light Lr. That is, the belt mark sensor 12 functions as a specular reflection type sensor.

Here, the belt mark sensor 12 corresponds to an example of a "sensor" of the present invention. Further, the belt mark sensor 12 and the print controller 6 correspond to an example of a "measurement unit" of the present invention.

<Belt Mark 330>

As shown by way of example in FIG. 2, a plurality of belt marks 330 are disposed on the outer circumferential surface of the intermediate transfer belt 33. In this example, the belt marks 330 are arranged at predetermined intervals in the rotating direction of the intermediate transfer belt 33. Further, the belt marks 330 are disposed at an end region (i.e., a non-image forming region) of the intermediate transfer belt 33 in a widthwise direction. In FIG. 2, four belt marks 330 among the plurality of the belt marks 330 are illustrated as belt marks 330-1, 330-2, 330-3 and 330-4 for convenience sake.

Here, a light reflectance of the belt mark 330 is set to be different from a light reflectance of the surface of the intermediate transfer belt 33. To be more specific, the light reflectance (i.e., specular reflectance) of the belt mark 330 is set to be lower than the light reflectance (i.e., specular reflectance) of the surface of the intermediate transfer belt 33. Such a magnitude relation in the light reflectance is achieved by, for example, baking predetermined regions (where the belt marks 330 are to be formed) of the surface of the intermediate transfer belt 33 by irradiation with predetermined laser light so as to form fine concavo-convex structures. The fine concavo-convex structures cause decrease in specular reflectance. That is, regions where the fine concavo-convex structures correspond to regions where the belt marks 330 are formed. In this regard, the light reflectance (i.e., specular reflectance) of the belt mark 330 may also be set to be higher than the light reflectance (i.e., specular reflectance) of the surface of the intermediate transfer belt 33.

As shown in FIG. 2, an interval ΔL1 between the belt marks 330 adjacent to each other in the rotating direction of the intermediate transfer belt 33 is substantially the same as a circumferential length m of the driving roller 34*a* (i.e., a length of one turn of the driving roller 34*a* in a rotating direction of the driving roller 34*a*). It is more preferable that the interval ΔL1 is the same as the circumferential length m of the driving roller 34*a*. That is, the intervals ΔL1 of the belt marks 330 are set so as to satisfy ΔL1≈m (more preferably, ΔL1=m).

Further, in this embodiment, a circumferential length (i.e., a length of one turn) L1 of the intermediate transfer belt 33 in the rotating direction is set to a length based on a natural number multiple (i.e., a positive integral multiple) of the circumferential length m of the driving roller 34*a*. In this example, as shown in FIG. 2, the following equation (1) is satisfied:

$$L1=(m\times N1) \quad (1)$$

where N1 is a natural number, and is, for example, 10.

<Fixing Device 4 and the Like>

The fixing device 4 shown in FIG. 1 is configured to apply heat and pressure to the toner image on the recording medium 9 (to which the toner image is secondarily transferred) conveyed in the conveyance direction d1, and fix the toner image to the recording medium 9.

The ejection sensor 51 is disposed downstream of the fixing device 4, and detects a leading end of the recording medium 9 conveyed in the conveyance direction d1. Further, the ejection rollers 52 are configured to eject the recording medium 9 (having been conveyed in the conveyance direction d1) outside the image forming apparatus 1.

<Print Controller 6>

The print controller 6 includes an arithmetic processing unit, and is configured to entirely control the image forming apparatus 1 and perform various processing. To be more specific, the print controller 6 has a function to convert print data (i.e., a print job) received from a not shown host device such as a PC (Personal Computer) through a communication line or the like into bit map data which is printable by the image forming apparatus 1. Further, the print controller 6 has a function to control operations of respective components of the image forming apparatus 1 including the image forming section 3 based on the print data (i.e., the bit map data) generated as described above. In other words, the print controller 6 performs a print control. The print controller 6 includes a CPU (Central Processing Unit), a ROM (Read Only Memory), a RAM (Random Access Memory), an IO (Input/Output) port, a timer, an operation program and the like. Here, the print controller 6 corresponds to an example of a "controller" of the present invention.

In this embodiment, the print controller 6 has a function to measure the rotation period of the intermediate transfer belt 33 using the belt marks 330 in cooperation with the belt mark sensor 12. Further, the print controller 6 has a function to adjust timings to form the developer images (i.e., toner images) in the image drum units 31C, 31M, 31Y and 31K according to the measurement result of the rotation period of the intermediate transfer belt 33. In this regard, detailed description of various functions (i.e., various operations) of the print controller 6 will be made later.

[Operation, Function and Effect]

<Basic Operation of Image Forming Apparatus 1>

The image forming apparatus 1 performs an image forming operation (i.e., a printing operation) as described below. When the print controller 6 receives print data from the host device (i.e., an external device) such as the PC via the communication line or the like, the print controller 6 performs print processing based on the print data so that respective components of the image forming apparatus 1 perform the following operations.

That is, as shown in FIG. 1, the hopping roller 21 rotates to feed the recording medium 9 from the supporting plate member 11*a* into the conveyance path. The conveying rollers 22*a* and 22*b* rotate to convey the recording medium 9 in the conveyance direction d1 along the conveyance path. The image forming section 3 forms toner images of respective colors on the conveyed recording medium 9.

To be more specific, the image drum unit 31C, 31M, 31Y and 31K of the image forming section 3 respectively form the toner images of respective colors using electrophotographic processes based on the print data. The toner images of respective colors are primarily transferred to the intermediate transfer belt 33 rotating in the conveyance direction d2. The toner image (having been primarily transferred to the intermediate transfer belt 33) on the intermediate transfer belt 33 is secondarily transferred to the conveyed recording medium 9 by the secondary transfer roller 35*a* and the secondary transfer backup roller 35*b*.

Then, the recording medium 9 is conveyed from the secondary transfer roller 35*a* to the fixing device 4. The fixing device 4 applies heat and pressure to the toner image on the recording medium 9, and fixes the toner image to the recording medium 9. The recording medium 9 with the fixed toner image is ejected by the ejection rollers 52 to outside of the image forming apparatus 1. In this way, the image forming operation (i.e., the printing operation) of the image forming apparatus 1 is completed.

<Image Alignment Operation>

In the above described image forming operation, an image alignment operation is performed as described below. That is, after the toner image is transferred to the intermediate transfer belt 33, the position of the recording medium 9 is detected by the writing sensor 23. Then, the image alignment operation is performed by adjusting a position of the conveyed recording medium 9 relative to a position of the toner image on the intermediate transfer belt 33. To be more specific, the conveyance speed of the recording medium 9 is adjusted while comparing a conveyance distance from the writing sensor 23 to the secondary transfer roller 35*a* and a conveyance distance from a toner image forming position (i.e., a primary transfer position) on the intermediate transfer belt 33 to a secondary transfer position (i.e., a position between the secondary transfer roller 35*a* and the secondary transfer backup roller 35*b*).

In this regard, the image forming section 3 has four image drum units 31C, 31M, 31Y and 31K, and therefore has four primary transfer positions. In this embodiment, a conveyance distance from the primary transfer position of one of the image drum units 31C, 31M, 31Y and 31K (for example, the most downstream image forming unit 31K) to the secondary transfer position is employed as the conveyance distance from the primary transfer position to the secondary transfer position.

With such an image alignment operation, the toner image can be secondarily transferred to a desired position on the recording medium 9.

However, if the conveyance speed (i.e., the rotation period) of the intermediate transfer belt 33 changes, a time required for the toner image on the intermediate transfer belt 33 to reach the secondary transfer position also changes. As a result, there is a possibility that the image alignment operation is not correctly performed. Particularly, an influence of the change in the conveyance speed becomes larger as the conveyance distance from the primary transfer position to the secondary transfer position becomes longer.

A cause of the change in the conveyance speed (i.e., the change in the rotation period) of the intermediate transfer belt 33 is, for example, a change in outer diameter of the driving roller 34*a* due to thermal expansion during a long time printing operation. To be more specific, if the outer diameter of the driving roller 34*a* increases due to the thermal expansion, the time required for the toner image on the intermediate transfer belt 33 to reach the secondary transfer position becomes shorter. As a result, the toner image may reach the secondary transfer position before the recording medium 9 reaches the secondary transfer position.

Therefore, the print controller 6 adjusts timings to form the toner images in the image drum unit 31C, 31M, 31Y and 31K (i.e., formation timings) according to the measurement result of the rotation period of the intermediate transfer belt 33 as described later. To be more specific, the print controller 6 adjusts the formation timings of the toner images by adjusting timings to perform exposure in the exposure heads 310C, 310M, 310Y and 310K of the image drum units 31C, 31M, 31Y and 31K.

<Measurement of Rotation Period of Intermediate Transfer Belt 33>

The rotation period of the intermediate transfer belt 33 is measured using the belt marks 330 and the belt mark sensor 12 as described below. During the rotation of the intermediate transfer belt 33, a period for each belt mark 330 to rotate one turn in the conveyance direction d2 is measured by the belt mark sensor 12 and the like as the rotation period of the intermediate transfer belt 33.

To be more specific, when the image forming apparatus 1 becomes a printable state and the intermediate transfer belt 33 reaches a predetermined speed, the belt mark sensor 12 emits the detection light Ld toward the surface of the intermediate transfer belt 33, and receives the reflected light Lr. As described above, the light reflectance of the belt mark 330 is lower than the light reflectance of the surface of the intermediate transfer belt 33, and therefore an amount of the reflected light Lr from the belt mark 330 is smaller than an amount of the reflected light Lr from the surface of the intermediate transfer belt 33. Therefore, the position of the belt mark 330 on the intermediate transfer belt 33 (i.e., an arrival of the belt mark 330 at a position facing the belt mark sensor 12) can be detected by detecting a difference (change) in the amount of the reflected light Lr received by the belt mark sensor 12.

The print controller 6 measures the rotation period of each belt mark 330 based on the interval ΔL1 of the adjacent belt marks 330 and the rotation speed of the driving roller 34*a*. The rotation period of the belt mark 330 measured in this way is obtained as the rotation period of the intermediate transfer belt 33.

In this regard, the print controller 6 and the belt mark sensor 12 may use, for example, an average value of the rotation periods of a plurality of the belt marks 330 to obtain the rotation period of the intermediate transfer belt 33. That is, the print controller 6 may calculate an average value of the rotation periods of the intermediate transfer belt 33 measured using the belt marks 330, and may use the average value as the rotation period of the intermediate transfer belt 33. For example, when the measured rotation periods of the four belt marks 330-1, 330-2, 330-3 and 330-4 are respectively expressed as t1, t2, t3 and t4, the rotation periods T of the intermediate transfer belt 33 may be obtained using the following equation (2):

$$T=(t1+t2+t3+t4)/4 \quad (2)$$

In this way, the measurement of the rotation period of the intermediate transfer belt 33 is performed. This measurement is continuously performed during the printing operation of the image forming apparatus 1.

<Adjustment of Image Formation Timing>

Then, the print controller 6 adjusts the formation timing of the toner image in each of the respective image drum units 31C, 31M, 31Y and 31K by adjusting the above described exposure timings according to the measurement result of the rotation period of the intermediate transfer belt 33.

To be more specific, the circumferential length of the intermediate transfer belt 33 is expressed as L1, and the conveyance distance from the primary transfer position to the secondary transfer position is expressed as L12. A changing amount of the rotation period of the intermediate transfer belt 33 is expressed as ΔT. Using L1, L12 and ΔT, an adjustment amount Δt (i.e., a correction time) of the formation timing of the toner image is expressed by the following equation (3):

$$\Delta t=-(\Delta T\times L12/L1) \quad (3)$$

That is, when the changing amount ΔT of the rotation period is a positive value, i.e., when the rotation period of the intermediate transfer belt 33 increases (in other words, when the rotation speed of the intermediate transfer belt 33 decreases), the adjustment amount Δt becomes a negative value. In this case, the print controller 6 advances (i.e., makes earlier) the formation timing (i.e., the exposure timing) of the toner image with respect to an original formation timing of the toner image by the adjustment amount Δt.

In contrast, when the changing amount ΔT of the rotation period is a negative value, i.e., when the rotation period of the intermediate transfer belt 33 decreases (in other words, when the rotation speed of the intermediate transfer belt 33 increases), the adjustment amount Δt becomes a positive value. In this case, the print controller 6 delays the formation timing (i.e., the exposure timing) of the toner image with respect to the original formation timing of the toner image by the adjustment amount Δt.

In this way, the formation timing of the toner image is adjusted. Therefore, even when the change in the outer diameter of the driving roller 34*a* due to the thermal expansion or the like causes a change in the conveyance speed (i.e., the rotation period) of the intermediate transfer belt 33, a deviation of an image forming position on the recording medium 9 is suppressed.

<Suppression of Measurement Variation of Rotation Period>

Generally, a rotation period of the driving roller 34*a* in the image forming section 3 may become uneven (i.e., may fluctuate with time) due to decentering or variation in outer diameter of the driving roller 34*a* or the like. Therefore, the conveyance speed of the intermediate transfer belt 33 rotated by the driving roller 34*a* also changes with time in conjunction with the fluctuation of the rotation period of the driving roller 34*a*.

Figure 3:
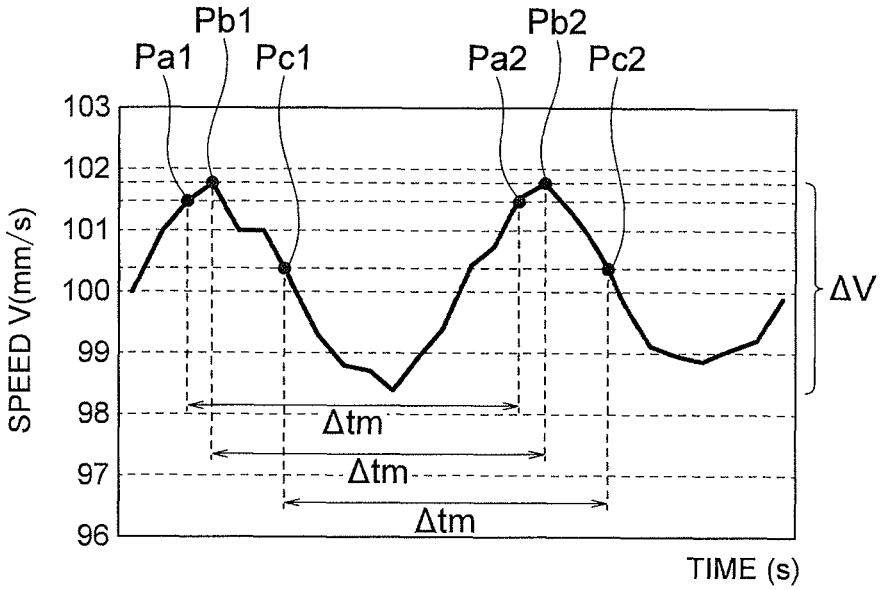
FIG. 3 is a view for illustrating an example of a change in speed of an intermediate transfer belt shown in FIG. 2 with respect to time.

To be more specific, as shown by way of example in FIG. 3, the speed (i.e., the conveyance speed) V of the intermediate transfer belt 33 fluctuates with time by a fluctuation amount ΔV in conjunction with a rotation period Δtm of the driving roller 34*a*.

In this embodiment, the circumferential length L1 of the intermediate transfer belt 33 in the rotating direction is set to be a length based on a natural number multiple of the circumferential length m of the driving roller 34*a*. To be more specific, the circumferential length L1 of the intermediate transfer belt 33 is set so as to satisfy the above described equation (1), i.e., L1=(m×N1) (N1: natural number).

Therefore, as shown in FIG. 3, a fluctuation of the speed V of the intermediate transfer belt 33 in conjunction with the rotation period Δtm of the driving roller 34*a* occurs N1 times while the intermediate transfer belt 33 rotates 1 turn (i.e., during the rotation period of the intermediate transfer belt 33). A conveyance speed of the belt mark 330 on the intermediate transfer belt 33 also repeats fluctuation N1 times during the rotation period of the intermediate transfer belt 33.

For this reason, as shown by way of example in FIG. 3, the speed (i.e., the conveyance speed) V of the intermediate transfer belt 33 measured based on the rotation periods (i.e., the conveyance speeds) of the belt marks 330 is not influenced by the fluctuation of the rotation period of the driving roller 34*a*. To be more specific, the speed V itself has different values as shown by marks Pa1, Pb1, Pc1 and the like in FIG. 3 depending on timings of measurement by the respective belt marks 330. However, when the speed V is measured a plurality of times using the respective belt marks 330, the value of the speed V does not change for every measurement. That is, it does not happen that the value of the speed V changes for every measurement. As a result, a measurement variation of the rotation period of the intermediate transfer belt 33 can be suppressed even when the rotation period of the driving roller 34*a* fluctuates.

As described above, according to this embodiment, when the rotation period of the intermediate transfer belt 33 is measured using the belt marks 330 formed on the intermediate transfer belt 33, the measurement variation of the rotation period can be suppressed (i.e., a measurement accuracy of the rotation period can be enhanced) even when the driving roller 34*a* has decentering or the like. Therefore, when the formation timing of the toner image is adjusted according to the measurement result of the rotation period of the intermediate transfer belt 33, an adjustment accuracy can be enhanced. As a result, a deviation of the image forming position can be suppressed, and an excellent image can be formed (i.e., image quality can be enhanced).

Further, in this embodiment, the interval ΔL1 between the adjacent belt marks 330 is set to be substantially the same as the circumferential length m of the driving roller 34*a*. In other words, ΔL1≈m (more preferably, ΔL1=m) is satisfied. Therefore, as shown by marks Pa1, Pa2 . . . , marks Pb1, Pb2 . . . and marks Pc1, Pc2 . . . in FIG. 3, the values of the speed V measured using the respective belt marks 330 become substantially constant. As a result, the rotation period of the intermediate transfer belt 33 can be measured in a simpler manner as compared with, for example, the first modification (FIGS. 4 and 5) described later. Thus, the formation timing of the toner image can be accurately adjusted in a simple manner. In this regard, this embodiment is not limited to a case where the interval ΔL1 of the belt marks 330 is substantially the same as the circumferential length m of the driving roller 34*a* (i.e., ΔL1≈m or ΔL1=m). Optionally, the interval ΔL1 of the belt marks 330 may be different from the circumferential length m of the driving roller 34*a* (i.e., ΔL1≠m).

Furthermore, in this embodiment, the average of the rotation periods of the intermediate transfer belt 33 measured using a plurality of the belt marks 330 is employed as the rotation period of the intermediate transfer belt 33 as expressed by the equation (2). With such an arrangement, the rotation period of the intermediate transfer belt 33 can be measured more accurately, and therefore a more excellent image can be formed. In this regard, the number of the belt marks 330 and values of the rotation periods (used for determining the average value) may be set, for example, by experiments so that the measurement can be stably performed.

2. Modifications

Modifications (i.e., first and second modifications) of the above described embodiment will be described. Components of the modifications that are the same as those of the embodiment are assigned with the same reference numerals, and explanations thereof are omitted.

[First Modification]

<Configuration>

Figure 4:
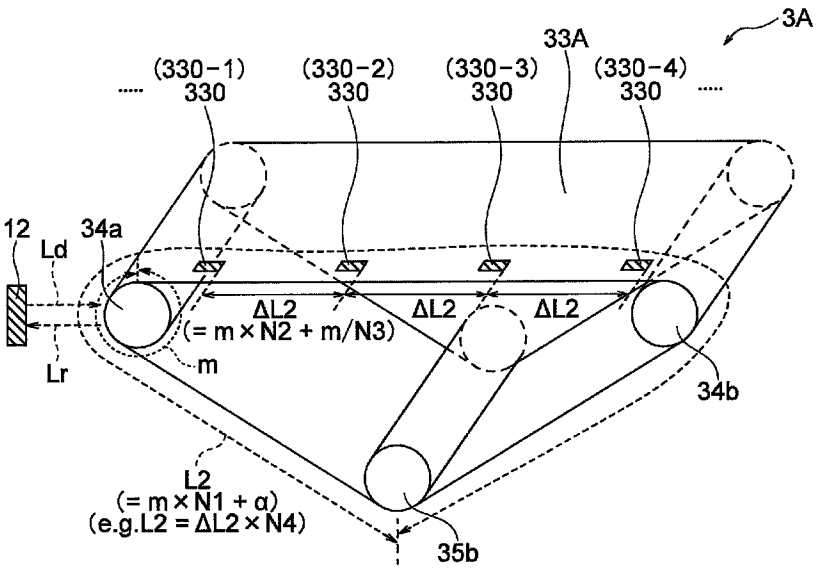
FIG. 4 is a schematic perspective view showing a configuration example of a part of an image forming section of the first modification.

FIG. 4 is a schematic perspective view schematically showing a configuration example of a part of an image forming section (i.e., an image forming section 3A) of the first modification. Other parts of an image forming apparatus of the first modification are the same as those of the embodiment, and explanations thereof are omitted.

The image forming section 3A of the first modification includes an intermediate transfer belt 33A instead of the intermediate transfer belt 33 of the image forming section 3 of the embodiment. Belt marks 330 are provided on the intermediate transfer belt 33A. An interval ΔL2 between the adjacent belt marks 330 on the intermediate transfer belt 33A is different from the interval ΔL1 of the adjacent belt marks 330 on the intermediate transfer belt 33 of the embodiment. Other components of the image forming section 3A are the same as those of the image forming section 3, and explanations thereof are omitted.

In the first modification, the circumferential length (i.e., a length of one turn) L2 of the intermediate transfer belt 33A in the rotating direction is set to be a length based on a natural number multiple (i.e., a positive integral multiple) of the circumferential length m of the driving roller 34*a*. However, unlike the circumferential length L1 of the intermediate transfer belt 33 of the embodiment, the circumferential length L2 of the intermediate transfer belt 33A is set to satisfy the following equation (4):

$$L2=\{(m\times N1)+\alpha\} \tag{4}$$

where N1 is a natural number, and α (≠0) is an excess length of the intermediate transfer belt 33A. In the above described embodiment, the circumferential length L1 of the intermediate transfer belt 33 is a natural number multiple of the circumferential length m of the driving roller 34*a* as expressed by the equation (1), i.e., L1=(m×N1). In contrast, the circumferential length L2 (i.e., L1+α) of the intermediate transfer belt 33A of the first modification is not a natural number multiple of the circumferential length m of the driving roller 34*a*.

The circumferential length L2 of the intermediate transfer belt 33A is preferably set to be a natural number multiple (i.e., a positive integral multiple) of the interval ΔL2 of the adjacent belt marks 330 described below. That is, it is preferable that L2=(ΔL2×N4) is satisfied, where N4 is a natural number. When the circumferential length L2 is set in this way, the belt marks 330 can be disposed at equal intervals on the intermediate transfer belt 33 without leaving an excess region. Therefore, when the rotation period of the intermediate transfer belt 33A is determined using the belt marks 330 (i.e., using an average value of the rotation periods) as described later, there is no unnecessary belt mark 330 (which cannot be used for calculation), and therefore convenience can be enhanced. In this regard, if the belt marks 330 cannot be equally arranged at the intervals ΔL2 on the intermediate transfer belt 33A (i.e., L2≠(ΔL2×N4)), the interval of the belt marks 330 may be set to be larger than ΔL2 (for example, 2×ΔL2) in the excess region of the intermediate transfer belt 33A.

The interval ΔL2 between the adjacent belt marks 330 on the intermediate transfer belt 33A of the first modification is set to satisfy the following equation (5):

$$\Delta L2=\{m\times N2+(m/N3)\} \tag{5}$$

where N2 and N3 are both natural numbers. For example, N2 is 1, and N3 is 4. That is, unlike the interval ΔL1 (=m) of the embodiment, the interval ΔL2 of the first modification is a sum of a natural number multiple of the circumferential length m of the driving roller 34*a* (m×N2) and an excess portion (m/N3).

In the first modification, the number of the belt marks 330 provided on the intermediate transfer belt 33A is preferably larger than or equal to the natural number N3. With such a setting, a calculation accuracy can be enhanced when the rotation period of the intermediate transfer belt 33A is measured using the belt marks 330 (i.e., using the average value of the rotation periods). Further, the number of the belt marks 330 used to calculate the average value is preferably a natural number multiple of the natural number N3, i.e., N3×N5, where N5 is a natural number. With such a setting, there is no unnecessary belt mark 330 when the rotation period is determined using the average value, and convenience can be enhanced.

<Operation, Function and Effect>

The image forming apparatus of the first modification performs a printing operation and a position alignment operation in similar manners to those of the image forming apparatus 1 of the embodiment.

However, in the first modification, unlike in the above described embodiment, the circumferential length L2 of the intermediate transfer belt 33A is not a natural number multiple of the circumferential length m of the driving roller 34*a*. To be more specific, the circumferential length L2 is a sum of the circumferential length L1 of the embodiment and the excess length α. That is, the circumferential length L2 is set so as to satisfy the above described equation (4), i.e., L2={(m×N1)+α}, where N1 is a natural number.

For this reason, in the first modification, unlike in the above described embodiment, when the rotation period of the intermediate transfer belt 33A is measured using the rotation periods of the belt marks 330, the result is as follows. That is, the value of the rotation period of the intermediate transfer belt 33A may vary according to a relative position of the belt mark 330 relative to the outer circumferential surface of the driving roller 34*a*.

For example, when 10 is substituted for N1 in the equation (4), and (m×¾) is substituted for a in the equation (4), the following equation (6) is obtained:

$$L2=\{(m\times 10)+\times 3/4)\} \quad (6)$$

In this case, a moving distance of the intermediate transfer belt 33A differs depending on a range of a rotation angle of the driving roller 34*a* when the driving roller 34*a* rotates to move the intermediate transfer belt 33A by an amount of (m×¾).

Therefore, in the first modification, the interval ΔL2 between the adjacent belt marks 330 on the intermediate transfer belt 33A of the first modification is set to satisfy the above described equation (5). For example, when 1 is substituted for N2 in the equation (5), and 4 is substituted for N3 in the equation (5), the following equation (7) is obtained.

$$\Delta L2=\{m+(m/4)\} \quad (7)$$

As compared with the interval ΔL1 (=m) of the above described embodiment, the interval ΔL2 has an excess portion of (m/4).

Figure 5:
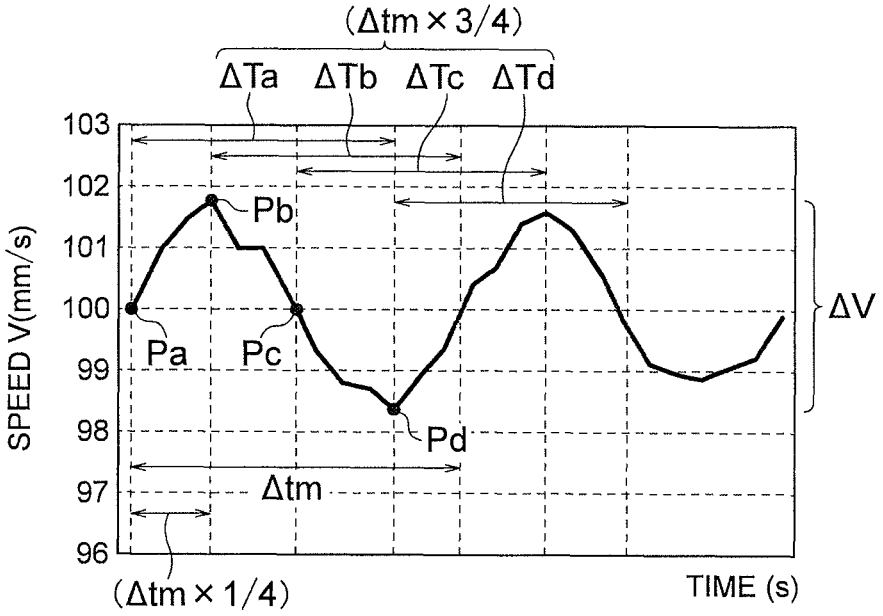
FIG. 5 is a view for illustrating an example of a change in speed of an intermediate transfer belt shown in FIG. 4 with respect to time.

Therefore, in the first modification, when the speed V of the intermediate transfer belt 33A is measured using the four belt marks 330-1, 330-2, 330-3 and 330-4 (FIG. 4) as shown in FIG. 5 as described in the embodiment, the result is as follows. That is, values of the speed V measured using the belt marks 330-1, 330-2, 330-3 and 330-4 respectively vary for every rotation of the intermediate transfer belt 33A due to presence of the excess length α=(m×¾) in the equation (6). That is, the measurement timing of the speed V (using each of the belt marks 330-1, 330-2, 330-3 and 330-4) is shifted by a time period of (Δtm×¾) for every rotation of the intermediate transfer belt 33A, for example, as shown by marks ΔTa, ΔTb, ΔTc and ΔTd in FIG. 5.

However, in this example, the four belt marks 330-1, 330-2, 330-3 and 330-4 are arranged at the equal intervals ΔL2, and each interval ΔL2 includes the excess portion of (m/4). Therefore, the values of the speed V measured using the belt marks 330-1, 330-2, 330-3 and 330-4 are measured at timings equally dividing the rotation period Δtm of the driving roller 34*a* into four (i.e., Δtm×¼) (for example, at timings respectively shifted by zero, a quarter, two quarters and three quarters of the rotation period Δtm of the driving roller 34*a*) as shown by marks Pa, Pb, Pc and Pd in FIG. 5.

Therefore, when the average value of the rotation periods of the four belt marks 330-1, 330-2, 330-3 and 330-4 is used as the rotation period of the intermediate transfer belt 33A as expressed by the equation (2) described in the embodiment, the result is as follows. That is, irrespective of the relative positions of the belt marks 330-1, 330-2, 330-3 and 330-4 relative to the outer circumferential surface of the driving roller 34*a*, the average value of the measured rotation periods becomes substantially constant. With such a method, in the first modification, the measurement variation of the rotation period of the intermediate transfer belt 33A can be suppressed even when the circumferential length L2 of the intermediate transfer belt 33 is not a natural number multiple of the circumferential length m of the driving roller 34*a* (i.e., when the circumferential length L2 has the excess length α) as expressed by the equation (4).

As described above, in the first modification, when the rotation period of the intermediate transfer belt 33A is measured using the belt marks 330 formed on the intermediate transfer belt 33A, the measurement variation of the rotation period can be suppressed (i.e., the measurement accuracy of the rotation period can be enhanced) even when the driving roller 34*a* has decentering or the like. Therefore, when the formation timing of the toner image is adjusted according to the measurement result of the rotation period of the intermediate transfer belt 33A, an adjustment accuracy can be enhanced. As a result, a deviation of the image forming position can be suppressed, and an excellent image can be formed (i.e. image quality can be enhanced).

Particularly, even when the circumferential length L2 of the intermediate transfer belt 33A has the excess length α as described above, the rotation period of the intermediate transfer belt 33A can be accurately measured, and the formation timing of the toner image can be accurately adjusted. Therefore, even when such an intermediate transfer belt 33A is used, the deviation of the image forming position can be suppressed, and the excellent image can be formed.

[Second Modification]

In the above described embodiment and the first modification, the image forming apparatuses of the intermediate transfer type have been described. In the second modification, an image forming apparatus of a direct transfer type will be described. The image forming apparatus of the direct transfer type is configured to transfer a toner image (i.e., a developer image) directly to a recording medium 9 without using the intermediate transfer belt. That is, in the above described embodiment and the first modification, the intermediate transfer belts 33 and 33A correspond to examples of the "transfer object" of the present invention. In contrast, in the second modification, the recording medium 9 corresponds to an example of the "transfer object" of the present invention.

<Configuration>

Figure 6:
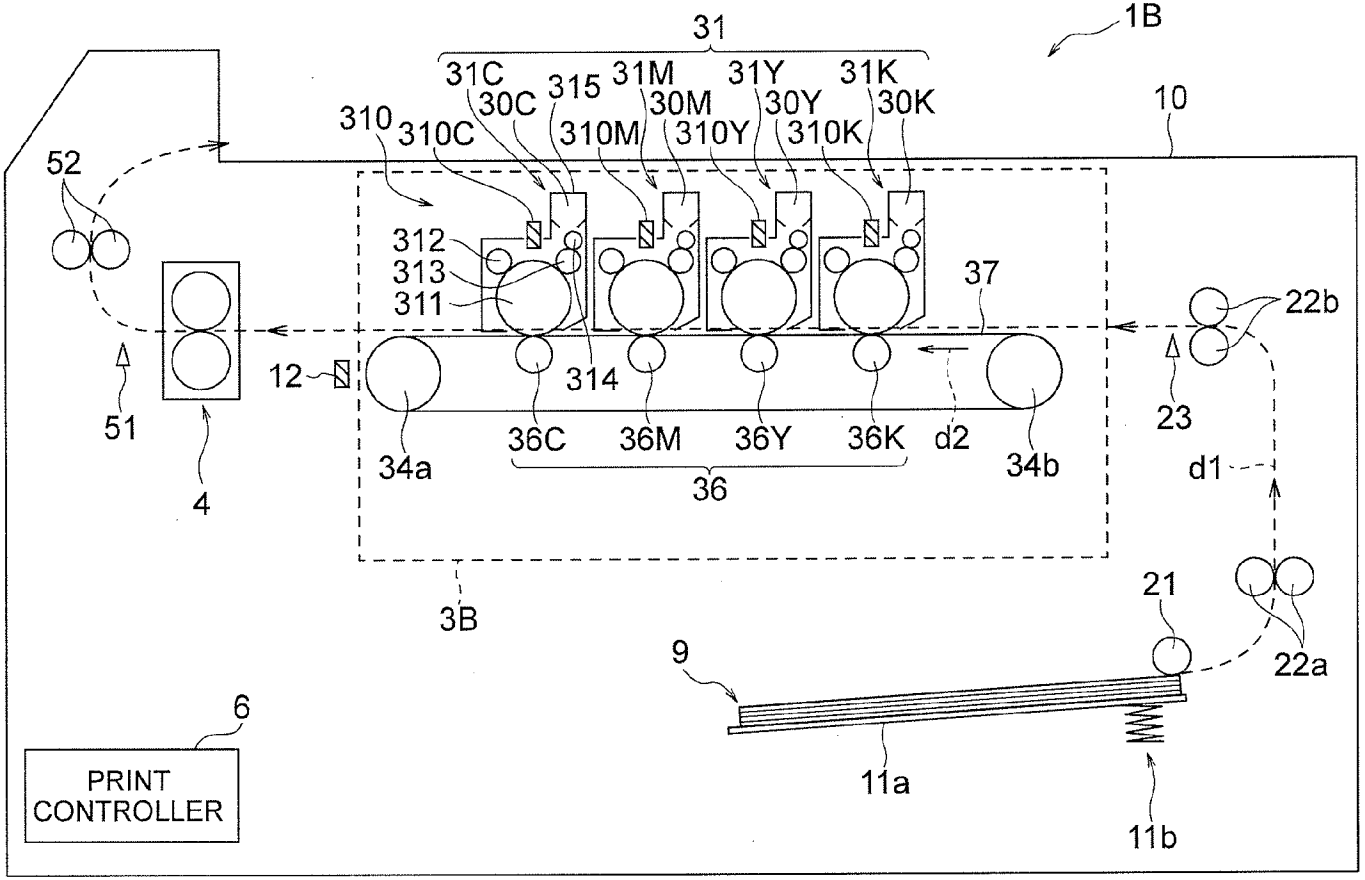
FIG. 6 is a schematic view showing a configuration example of an image forming apparatus according to the second modification.

FIG. 6 is a schematic view showing a configuration example of an image forming apparatus (i.e., an image forming apparatus 1B) according to the second modification. The image forming apparatus 1B functions as a printer (for example, a color printer) that forms an image (for example, a color image) on the recording medium 9 using the electrophotographic method. However, the image forming apparatus 1B is of the direct transfer type as described above. Here, the image forming apparatus 1B corresponds to an example of the "image forming apparatus" of the present invention.

As shown in FIG. 6, the image forming apparatus 1B includes a supporting plate member 11*a*, a hopping roller 21, two pairs of conveying rollers 22*a* and 22*b*, a writing sensor 23, an image forming section 3B, a belt mark sensor 12, a fixing device 4, an ejection sensor 51, a pair of ejection rollers 52, and a print controller 6. These components are housed in a predetermined housing 10 as shown in FIG. 6.

The image forming section 3B includes four image drum units (i.e., image forming units) 31C, 31M, 31Y and 31K, four transfer rollers 36C, 36M, 36Y and 36K, a transfer belt (i.e., a conveyance belt) 37, a driving roller 34*a*, and an idle roller 34*b* as shown in FIG. 6.

The image drum units 31C, 31M, 31Y and 31K are arranged in a conveyance direction d1 (i.e., along a conveyance path d1) of the recording medium 9 as shown in FIG. 6. To be more specific, the image drum units 31K, 31Y, 31M and 31C are arranged in this order in the conveyance direction d1, i.e., from upstream to downstream. Exposure heads 310C, 310M, 310Y, 310K are disposed so as to respectively face the image drum units 31C, 31M, 31Y and 31K.

The transfer belt 37 is configured to convey the recording medium 9 in the conveyance direction d1. As shown in FIG. 6, the transfer belt 37 is driven by the driving roller 34*a* to rotate in a conveyance direction d2. Here, the transfer belt 37 corresponds to an example of the "transfer belt" of the present invention. A plurality of the above described belt marks 330 are provided on the transfer belt 37.

The transfer rollers 36C, 36M, 36Y and 36K are configured to electrostatically transfer the toner images of respective colors formed by the image drum units 31C, 31M, 31Y and 31K to the recording medium 9. As shown in FIG. 6, the transfer rollers 36C, 36M, 36Y and 36K are disposed so as to respectively face the image drum units 31C, 31M, 31Y and 31K via the transfer belt 37. Here, the transfer rollers 36C, 36M, 36Y and 36K correspond to examples of the "transfer portion" of the present invention.

In the second modification, the belt mark sensor 12 is disposed beside the image forming section 3B as shown in FIG. 6. To be more specific, the belt mark sensor 12 is disposed in the vicinity of the driving roller 34*a*. Further, the belt mark sensor of the second modification performs a predetermined measurement in cooperation with the print controller 6 by emitting detection light Ld toward a surface of the transfer belt 37 or the belt mark 330 formed thereon, and receiving reflected light Lr from the surface of the transfer belt 37 or the belt mark 330. That is, the belt mark sensor 12 measures a rotation period of the transfer belt 37 using the detection light Ld and the reflected light Lr. In other words, the belt mark sensor 12 functions as a sensor for measuring the rotation period of the transfer belt 37.

The print controller 6 is configured to entirely control the image forming apparatus 1B and perform various processing as described in the embodiment and the first modification. To be more specific, the print controller 6 has a function to measure the rotation period of the transfer belt 37 using the belt marks 330 in cooperation with the belt mark sensor 12. Further, the print controller 6 has a function to adjust timings to form the developer images (i.e., toner images) in the image drum units 31C, 31M, 31Y and 31K according to the measurement result of the rotation period of the transfer belt 37.

<Operation, Function and Effect>

The image forming apparatus 1B of the second modification provides the same functions and the same effects as in the embodiment and the first modification. That is, when the formation timing of the toner image is adjusted according to the measurement result of the rotation period of the transfer belt 37, an adjustment accuracy can be enhanced by using the method described in the embodiment or the first modification. As a result, a deviation of the image forming position can be suppressed, and an excellent image can be formed (i.e., image quality can be enhanced).

3. Other Modifications

Although the embodiment of the present invention and the modifications have been described, the present invention is not limited to the embodiment and the modifications, but various changes may be made thereto.

In the embodiment and the modifications, examples of characteristics (i.e., shapes, arrangements, numbers and the like) of respective components of the image forming apparatus have been described. However, the characteristics of the respective components of the image forming apparatus are not limited to the examples. The respective components of the image forming apparatus may have other shapes, arrangements, numbers and the like. Parameters and magnitude relations are not limited to those described in the embodiment and the modifications, but other parameters and magnitude relations may be employed.

In the embodiment and the modifications, measurement methods of the rotation periods of the intermediate transfer belts 33 and 33A and the transfer belt 37 using the belt marks 330 and the belt mark sensor 12 have been described. The measurement methods are not limited to those described above, but other measurement methods may be employed.

In the embodiment and the modifications, four image drum units 31C, 31M, 31Y, 31K are provided. However, the number of the image drum units (i.e., image forming units) is not limited. The number of the image drum units, a combination of colors of toners used therein, and an order of arrangement of the image drum units may be arbitrarily determined according to purpose or use. In some cases, the image forming apparatus may include a single image drum unit and may be configured to form a monochrome image. That is, the image forming apparatus may be configured as a monochrome printer.

The processing described in the embodiment and the modifications may be performed by hardware (i.e., a circuit) or software (i.e., a program). When the processing is performed by software, the software may include a group of programs for a computer to perform respective functions. The programs may be preliminarily installed in the computer, or may be installed in the computer via a network or a recording medium.

In the embodiment and the modifications thereof, the image forming apparatus (i.e., the printer) having a printing function has been described as an example of the "image forming apparatus" of the present invention. However, the present invention is also applicable to image forming apparatuses (for example, a scanner, a copier or a facsimile machine) having a scanning function, a copying function and a facsimile function, and is also applicable to an image forming apparatus such as an MFP (Multi-Function Peripheral) having two or more of these functions.

In the above described embodiment and the modifications, a cut sheet has been described as an example of the recording medium. However, the recording medium is not limited to the cut sheet, but an elongated medium, a roll medium, or a label sheet may be used as the recording medium.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

an image forming unit that forms a developer image;

a transfer portion that transfers the developer image formed by the image forming unit to a transfer object;

an endless transfer belt that rotates passing through between the image forming unit and the transfer portion;

a driving roller that drives the transfer belt to rotate;

a plurality of marks provided on the transfer belt and arranged in a rotating direction of the transfer belt;

a measurement unit that measures a rotation period of the transfer belt using the plurality of marks; and a controller that adjusts a timing at which the image forming unit forms the developer image, based on a measurement result of the rotation period measured by the measurement unit, wherein a circumferential length L of the transfer belt in the rotating direction is set to a length based on a natural number multiple of a circumferential length m of the driving roller.

2. The image forming apparatus according to claim 1, wherein the circumferential length L of the transfer belt is set so as to satisfy the following equation (1):

$$L=(m\times N1) \quad (1)$$

where N1 is a natural number.

3. The image forming apparatus according to claim 2, wherein the measurement unit determines an average rotation period based on the rotation periods measured using the plurality of marks.

4. The image forming apparatus according to claim 3, wherein an interval ΔL between the marks adjacent to each other in the rotating direction is set to substantially the same as the circumferential length m of the driving roller.

5. The image forming apparatus according to claim 1, wherein an interval ΔL between the marks adjacent to each other in the rotating direction is set so as to satisfy the following equation:

$$\Delta L=(m\times N2+(m/N3)) \quad (2)$$

where N2 and N3 are both natural numbers.

6. The image forming apparatus according to claim 5, wherein the number of the marks is greater than or equal to the natural number N3.

7. The image forming apparatus according to claim 6, wherein the measurement unit determines an average rotation period based on the rotation periods measured using the plurality of marks.

8. The image forming apparatus according to claim 7, wherein the number of the marks used to determine the average rotation period is a natural number multiple of the natural number N3.

9. The image forming apparatus according to claim 1, wherein the measurement unit includes a sensor that measures the rotation period by emitting detection light toward the transfer belt or the mark and receiving the detection light reflected from the transfer belt or the mark.

10. The image forming apparatus according to claim 9, wherein a light reflectance of a surface of the transfer belt is different from a light reflectance of the marks.

11. The image forming apparatus according to claim 1, wherein the transfer object is an intermediate transfer belt as the transfer belt, wherein the transfer portion primarily transfers the developer image to the intermediate transfer belt, and secondarily transfers the developer image from the intermediate transfer belt to a recording medium.

12. The image forming apparatus according to claim 1, wherein the transfer object is a recording medium conveyed by the transfer belt, wherein the transfer portion transfers the developer image directly to the recording medium.

13. The image forming apparatus according to claim 1, wherein the circumferential length L of the transfer belt is a natural number multiple of an interval ΔL between the marks adjacent to each other in the rotating direction.

14. The image forming apparatus according to claim 1, wherein the plurality of marks are formed of the transfer belt itself.

* * * * *